US008947484B2

(12) United States Patent
Aizawa et al.

(10) Patent No.: US 8,947,484 B2
(45) Date of Patent: Feb. 3, 2015

(54) PRINTER

(71) Applicant: Seiko Instruments Inc., Chiba (JP)

(72) Inventors: Kazuyuki Aizawa, Chiba (JP); Hiroyuki Kohira, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 14/308,066

(22) Filed: Jun. 18, 2014

(65) Prior Publication Data

US 2015/0002605 A1 Jan. 1, 2015

(30) Foreign Application Priority Data

Jun. 27, 2013 (JP) ..... 2013-135270

(51) Int. Cl.

| | |
|---|---|
| ***B41J 2/325*** | (2006.01) |
| ***B41J 2/315*** | (2006.01) |
| ***B41J 2/32*** | (2006.01) |
| ***B41J 3/00*** | (2006.01) |
| ***B41J 29/02*** | (2006.01) |

(52) U.S. Cl.

CPC ..... *B41J 29/02* (2013.01)
USPC ..... 347/222; 347/221; 347/171; 347/2

(58) Field of Classification Search

USPC ..... 347/222, 221, 2, 171
See application file for complete search history.

(56) References Cited

U.S. PATENT DOCUMENTS 8,529,146 B2 * 9/2013 Yoshioka ..... 400/691

FOREIGN PATENT DOCUMENTS

JP 2002137493 5/2002
JP 2002137493 A * 5/2002

* cited by examiner

*Primary Examiner* — Sarah Al Hashimi
(74) *Attorney, Agent, or Firm* — Adams & Wilks

(57) ABSTRACT

A printer comprising: a housing having an accommodating portion that accommodates recording paper and opens in a direction crossing the direction of gravity; a cover coupled to the housing in an openable and closable manner, and closing the accommodating portion; a control unit provided on the cover and having a circuit board; an lever provided in the housing at a position above the control unit in the direction of gravity and opening the cover; and a discharge path provided on the cover outside the control unit and leading liquid having entered through between the lever and the control unit toward an area below the control unit in the direction of gravity, wherein the discharge path including an upstream side end disposed on the cover below the lever in the direction of gravity.

7 Claims, 16 Drawing Sheets

PRINTER

BACKGROUND OF THE INVENTION

1. Field of the Invention

The present invention relates to a printer.

2. Description of the Related Art

As a typical example of a thermal printer, in a printer of drawing out recording paper from a recording paper roll and performing printing on the recording paper, there are known a number of printers in which a printer cover is coupled in an openable and closable manner to a housing accommodating the recording paper roll so as to allow easy setting of the recording paper roll.

Thermal printers are often used within locations of restaurants or like. In this case, liquid such as water adhering to the hands of the user and water scattering from the kitchen or the like may enter the interior of the printer through a boundary portion between the housing and the printer cover, and adhere to the recording paper or a circuit board. Adhesion of liquid to the recording paper, the circuit board or the like becomes a factor causing poor printing and electronic component failure. Accordingly, protection of a printer from liquid (hereinafter referred to as "drip-proof") is demanded, for example a printer is demanded to have a structure preventing entrance of water into the interior, and a structure capable of discharging water having entered the interior of the printer without adhesion of the water to the recording paper, the circuit board or the like.

For example, as this type of printer, there is known a printer which includes a paper discharge recess on an upper surface of a printer housing, a slit-shaped paper discharge opening which is provided within the paper discharge recess and through which a sheet after printing is discharged from the inside of the paper discharge recess to the outside of the printer housing, and a water discharge groove formed so as to be along the paper discharge opening and at a position lower than the paper discharge opening within the paper discharge recess. This printer is expected to be capable of preventing entrance of water through the paper discharge opening, and also capable of positively discharging water within the water discharge groove.

Currently, it is desired to reduce the footprint of a thermal printer and to decrease the printer size as much as possible in order to improve the handling easiness for the user. For reducing the size of a printer, it is necessary to provide a printer mechanism including a printing head, a platen roller and the like, a cover opening/closing operation mechanism for locking and releasing a printer cover, a control unit for controlling the operation of the printer, and the like in a limited space inside the housing.

According to the technology of the related-art printer discussed above, however, the water discharge groove is formed so as to be at a position lower than the paper discharge opening, and thus such configuration is adopted that the paper discharge recess is set in the interior of the housing. Therefore, the size of the housing may increase by the space of the paper discharge recess. Accordingly, there remains a problem in the related art, in terms of securing a drip-proof property while suppressing increase in the size of the printer.

Under the above circumstances, there is desired in the art a printer capable of suppressing increase in the size of the printer and also capable of securing a drip-proof property.

SUMMARY OF THE INVENTION

A printer according to an aspect of the present invention comprises: a housing having an accommodating portion that accommodates recording paper and opens in a direction crossing the direction of gravity; a printer cover coupled to the housing in an openable and closable manner, and closing the accommodating portion; a control unit provided on the printer cover and having an operation circuit board; an operation lever provided in the housing at a position above the control unit in the direction of gravity and operated at the time of performing at least either opening operation of the printer cover or closing operation of the printer cover; and a discharge path provided on the printer cover outside the control unit and leading liquid having entered through between the operation lever and the control unit toward an area below the control unit in the direction of gravity, wherein an upstream side end of the discharge path is disposed on the printer cover below the operation lever in the direction of gravity.

According to a printer of an aspect of the present invention, by providing the control unit having the operation circuit board on the printer cover, there is no need to secure at the housing side a space necessary for attachment of the control unit. Accordingly, increase in the size of the housing can be suppressed. Moreover, the discharge path that leads liquid having entered through between the operation lever and the control unit toward an area below the control unit in the direction of gravity is provided on the printer cover outside the control unit. Thus, liquid can be discharged while preventing adhesion of liquid to the recording paper accommodated in the accommodating portion of the housing and to the interior of the control unit provided on the printer cover. In particular, the upstream side end of the discharge path is disposed below the operation lever in the direction of gravity, and thus liquid having traveled along the operation lever can drop by gravity, and be introduced into the upstream side end of the discharge path to flow through the discharge path. Accordingly, a printer capable of suppressing increase in size and also capable of securing a drip-proof property can be obtained.

Further, a projection portion is formed in the operation lever, and a tip of the projection portion is disposed at a position corresponding to the discharge path above the discharge path in the direction of gravity when the printer cover is in a closed state.

According to a printer of an aspect of the present invention, since the tip of the projection portion formed in the operation lever is disposed at the position corresponding to the discharge path when the printer cover is in the closed condition, liquid having traveled along the operation lever is dropped from the tip of the projection portion toward the discharge path by gravity. Accordingly, since liquid having traveled along the operation lever can be securely introduced into the discharge path, the drip-proof property can be improved.

Further, an extended portion extended toward the inside of the housing is provided between the operation lever and the discharge path. The extended portion covers the operation circuit board as viewed from above in the direction of gravity. A tip of the extended portion is disposed at a position corresponding to the discharge path.

According to a printer of an aspect of the present invention, since the extended portion covers the operation circuit board as viewed from above in the direction of gravity and the tip of the extended portion is disposed at a position corresponding to the discharge path, adhesion of liquid to the operation circuit board from above in the direction of gravity can be securely prevented and also liquid having traveled along the extended portion can be securely introduced into the discharge path. Therefore, the drip-proof property can be further improved.

Further, the housing has a partitioning wall raised toward above in the direction of gravity outside in the width direction of the recording paper accommodated in the accommodating portion, and a downstream side end of the discharge path is disposed on a side opposite to the recording paper with the partitioning wall interposed between the downstream side end and the recording paper.

According to a printer of an aspect of the present invention, since the downstream side end of the discharge path is disposed on the side opposite to the recording paper with the partitioning wall interposed between the downstream side end and the recording paper, liquid dropped from the downstream side end of the discharge path can be prevented from flowing into the recording paper side. Accordingly, adhesion of liquid to the recording paper can be securely prevented.

Further, a first reservoir is provided outside in the width direction of the recording paper.

According to a printer of an aspect of the present invention, since liquid discharged from the discharge path can be stored in the first reservoir provided outside in the width direction of the recording paper, adhesion of liquid to the recording paper can be securely prevented.

Further, a second reservoir communicating with the first reservoir is provided inside the housing with respect to the first reservoir, and a discharge hole is provided in the bottom of the second reservoir.

According to a printer of an aspect of the present invention, by providing the second reservoir in addition to the first reservoir, a larger amount of liquid can be stored. In addition, since the discharge hole is provided in the bottom of the second reservoir, liquid can be effectively discharged. Besides, since the second reservoir is provided inside the housing with respect to the first reservoir, the discharge hole can be provided inside the housing with respect to the first reservoir. Accordingly, the discharge hole can be provided while a favorable external appearance of the printer is maintained.

Further, the discharge path is formed integrally with a protection cover provided in an exterior of the control unit and covering the operation circuit board.

According to a printer of an aspect of the present invention, the discharge path can be provided without increasing the number of components and with high spatial efficiency. Moreover, by providing the discharge path on the protection cover that is provided in the exterior of the control unit and covers the operation circuit board, adhesion of liquid to the operation circuit board can be securely prevented. Accordingly, a printer with small size and low cost capable of securing an excellent drip-proof property can be provided.

As described above, according to a printer of an aspect of the present invention, by providing the control unit having the operation circuit board on the printer cover, there is no need to secure at the housing side a space necessary for attachment of the control unit. Accordingly, the size of the housing can be suppressed. Moreover, the discharge path which leads liquid having entered through between the operation lever and the control unit toward an area below the control unit in the direction of gravity is provided on the printer cover outside the control unit, and thus liquid can be discharged while preventing adhesion of liquid to the recording paper accommodated in the accommodating portion of the housing, and to the interior of the control unit provided on the printer cover. In particular, since the upstream side end of the discharge path is disposed below the operation lever in the direction of gravity, liquid having traveled along the operation lever can drop by gravity, and be introduced into the upstream side end of the discharge path to flow through the discharge path. Accordingly, a printer capable of suppressing increase in size and also capable of securing a drip-proof property can be obtained.

DETAILED DESCRIPTION OF THE PREFERRED EMBODIMENTS

An embodiment according to the present invention is hereinafter described with reference to the drawings. Note that in the present embodiment, a thermal printer used in a POS register system or the like will be discussed as an example.

Figure 1:
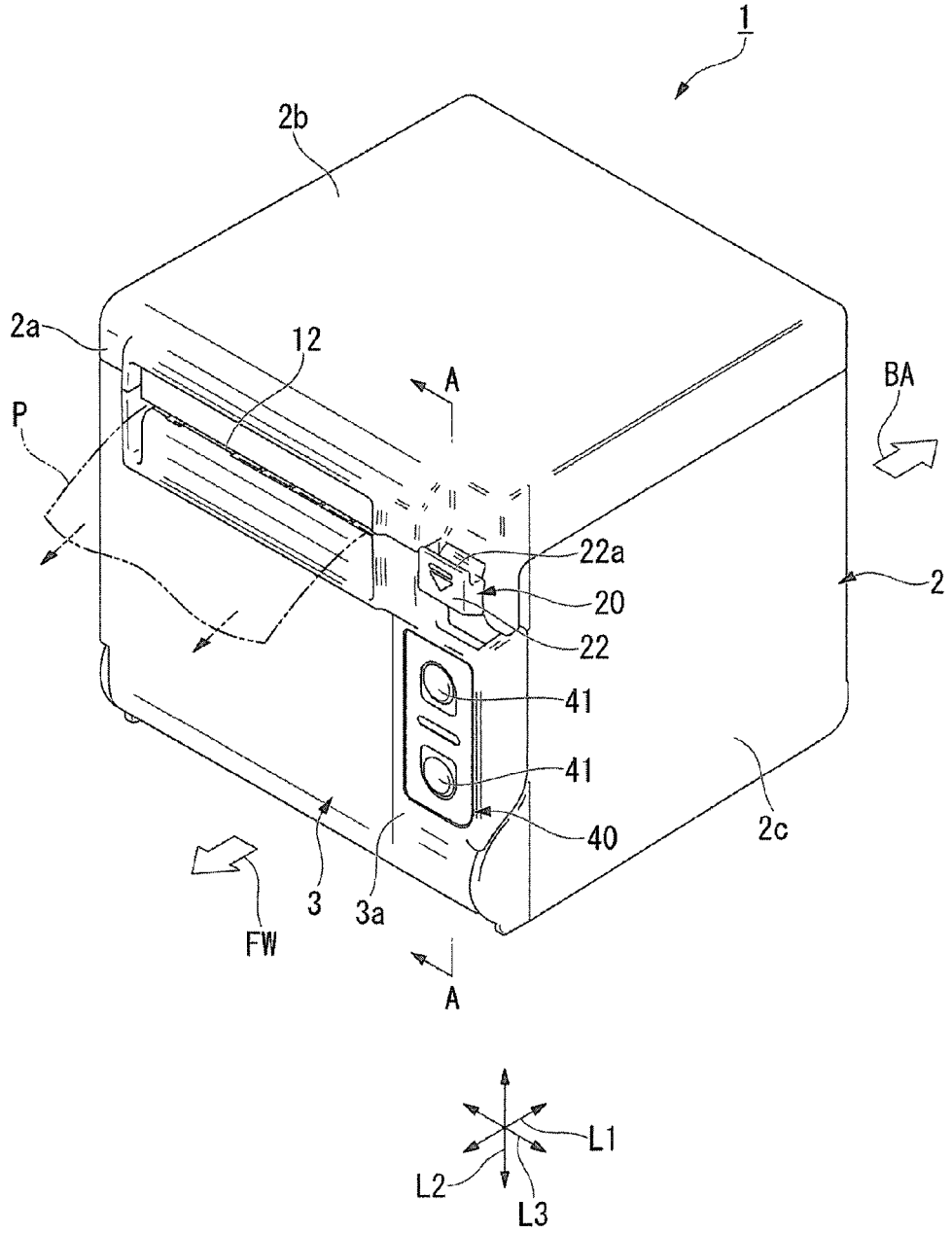
FIG. 1 is a perspective view of an external appearance of a thermal printer according to the present embodiment.
Figure 2:
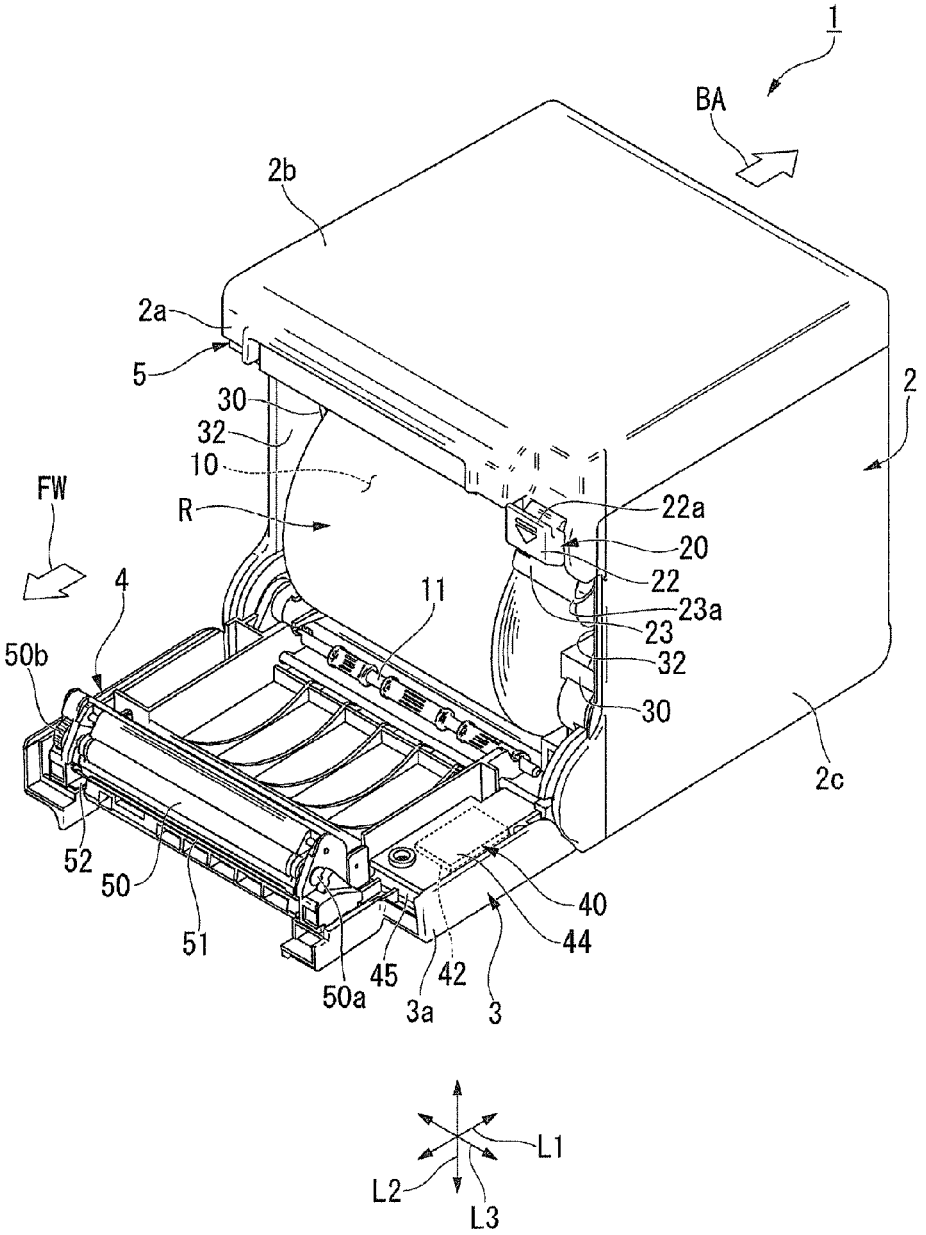
FIG. 2 is a perspective view of an external appearance illustrating a state in which a printer cover is opened.

FIG. 1 is a perspective view of an external appearance of a thermal printer 1 according to the present embodiment. FIG. 2 is a perspective view of an external appearance of illustrating a state in which a printer cover 3 is opened. Note that in the states illustrated in FIGS. 1 and 2, the upward direction and the downward direction in the figures correspond to the upward direction with respect to the direction of gravity (hereinafter abbreviated as "upward direction") and downward direction with respect to the direction of gravity (hereinafter abbreviated as "downward direction"), respectively. Further, it is assumed that the lower left side in FIGS. 1 and 2 corresponds to the frontward direction (the direction indicated by an arrow FW), the upper right side corresponds to the rearward direction (the direction indicated by an arrow BA) and recording paper P is fed toward the front. Further, it is assumed that the front-rear direction is L1, the up-down direction is L2, and the direction crossing the front-rear direction L1 and the up-down direction L2 at right angles is a left-right direction L3.

As illustrated in FIG. 1, the thermal printer 1 in the present embodiment is a printer which performs printing on the recording paper P such as heat-sensitive paper that can be utilized as tickets, receipts or the like. The thermal printer 1 includes a casing 2, the printer cover 3, and an operation lever 20. As illustrated in FIG. 2, the thermal printer 1 includes a platen unit 4 and a head unit 5 in an interior of the thermal printer 1.

The casing 2 is made of a resin material, a metal material, or an appropriate combination of these materials, and for example, has a box shape open to the front. The casing 2 includes a frame body serving as a basic framework, and an external cover covering the frame body.

The interior of the casing 2 serves as an accommodating portion 10 open to the front. The accommodating portion 10 is opened by opening the printer cover 3. A roll (hereinafter referred to as "recording paper roll") R of the recording paper P wound in a cylindrical shape is accommodated in the accommodating portion 10. As illustrated in FIG. 1, a clearance is formed between a tip of the printer cover 3 and the casing 2 when the printer cover 3 is in a closed state. The recording paper P is drawn from the interior of the casing 2 through this clearance toward the front and discharged. In other words, the clearance between the tip of the printer cover 3 and the casing 2 functions as a discharge opening 12 of the recording paper P. Note that the printer cover 3 locks at the time of closing operation. More specifically, the platen unit 4 and the head unit 5 are joined and integrally coupled with each other to lock the printer cover 3. Further, the operation lever 20 is provided at a corner of the casing 2 where a front wall 2*a*, an upper wall 2*b*, and one of side walls 2*c* cross each other. The operation lever 20 is operated at the time of opening operation of the printer cover 3 and releases the lock of the printer cover 3. The operation lever 20 will be detailed in details later.

The accommodating portion 10 includes a pair of side walls 30, and a support wall 31 (see FIG. 3) being in contact with an outer circumferential surface of the recording paper roll R and supporting the recording paper roll R from below. Note that the pair of side walls 30 and the support wall 31 form a part of the frame body constituting the casing 2. The pair of side walls 30 is disposed opposed to each other in the left-right direction L3 with the accommodated recording paper roll R interposed between the pair of the side walls 30. The distance between the pair of side walls 30 is slightly longer than the lateral width of the recording paper roll R. Accordingly, both end surfaces of the accommodated recording paper roll R are supported by inner wall surfaces of the pair of side walls 30, and the position of the recording paper roll R is regulated in the left-right direction L3.

Figure 3:
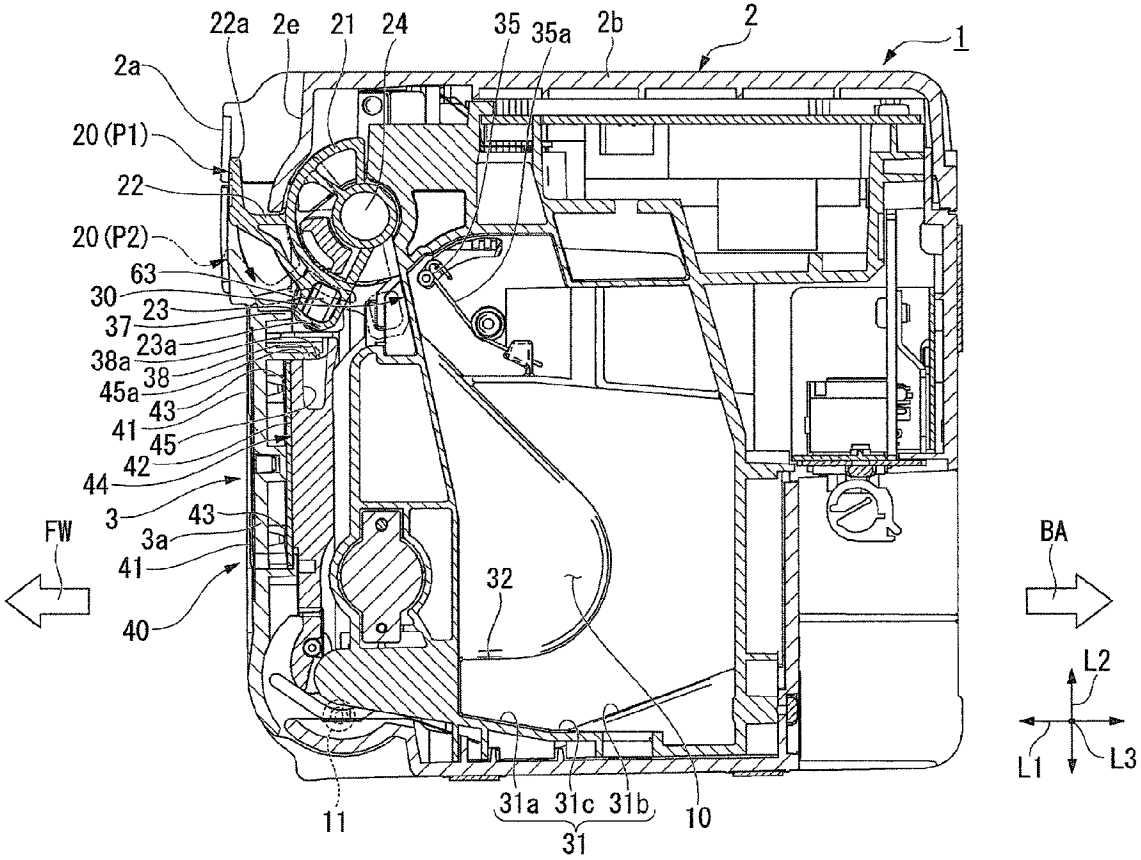
FIG. 3 is a cross-sectional view taken along a line A-A in FIG. 1.
Figure 4:
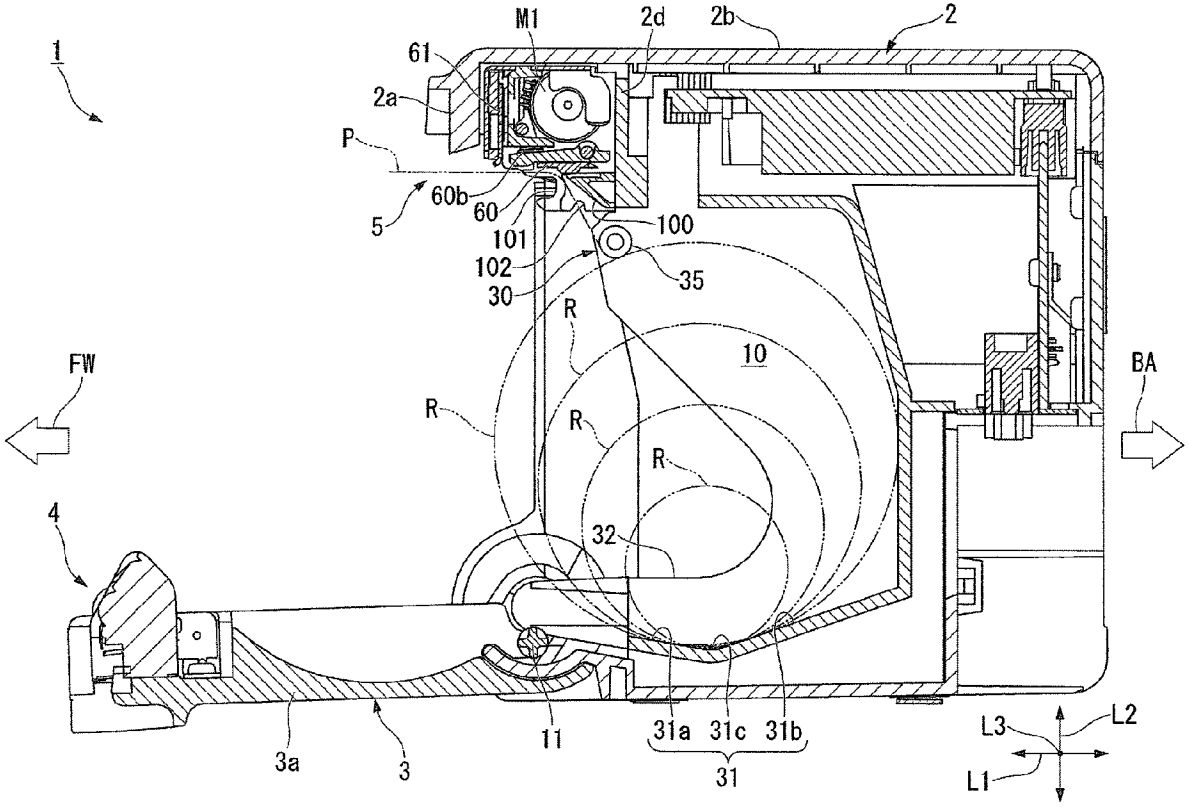
FIG. 4 is a vertical cross-sectional view of the thermal printer in the state shown in FIG. 2.

FIG. 3 is a cross-sectional view taken along a line A-A in FIG. 1. FIG. 4 is a vertical cross-sectional view of the thermal printer 1 in the state shown in FIG. 2. Note that in FIG. 4, the recording paper P and the recording paper roll R are indicated by two-dot chain lines. As illustrated in FIG. 3, the support wall 31 has a V shape in the vertical cross-sectional view, formed by a first support surface 31*a* positioned on the upstream side in the rotation direction of the recording paper roll R, a second support surface 31*b* positioned on the downstream side in the rotation direction of the recording paper roll R, and a bottom 31*c* positioned between the first support surface 31*a* and the second support surface 31*b* and continuously connected with the first support surface 31*a* and the second support surface 31*b*. Accordingly, the recording paper roll R is stably supported while shifting downward toward the bottom 31*c* as the diameter decreases in use. Accordingly, the recording paper roll R accommodated in the accommodating portion 10 is stably and rotatably supported by the pair of side walls 30 and the support wall 31 regardless of the diameter, without looseness in the up-down direction L2 and the left-right direction L3.

As illustrated in FIGS. 2 to 4, a notch 32 opened to the inside and the front of the casing 2 is formed in each of the pair of side walls 30. According to the example illustrated in the figures, the notch 32 has a circular-arc shape as viewed in the side view such that the length in the up-down direction L2 decreases from the front toward the rear. Therefore, both the end surfaces of the recording paper roll R accommodated in the accommodating portion 10 can be exposed through spaces defined by the notches 32 (see FIG. 2). Thus, by utilizing these spaces, the recording paper roll R can be removed from the accommodating portion 10 by holding both end surfaces of the recording paper roll R without touching the outer circumferential surface of the recording paper roll R, for example. Note that the spaces defined by the notches 32 function as access spaces through which the recording paper roll R can be easily accessed.

Further, as illustrated in FIG. 4, a tension roller 35 is provided between the pair of side walls 30 so as to be stretched in the left-right direction L3. The tension roller 35 urges the recording paper P drawn from the recording paper roll R by using an urging member such as a sprint 35*a* to give tension to the recording paper P. Accordingly, the recording paper P is drawn from the recording paper roll R in a state difficult to be loosened, and supplied between the platen unit 4 and the head unit 5.

As illustrated in FIG. 2, the platen unit 4 is a unit where a platen roller 50 and a fixed cutter 51 are assembled. The platen unit 4 is provided on the printer cover 3. More specifically, the platen unit 4 is attached to the inner surface of the tip side of the printer cover 3 via an attachment plate 52. Accordingly, the platen unit 4 shifts in association with the opening and closing operation of the printer cover 3, and can be relatively joined with the head unit 5.

Figure 5:
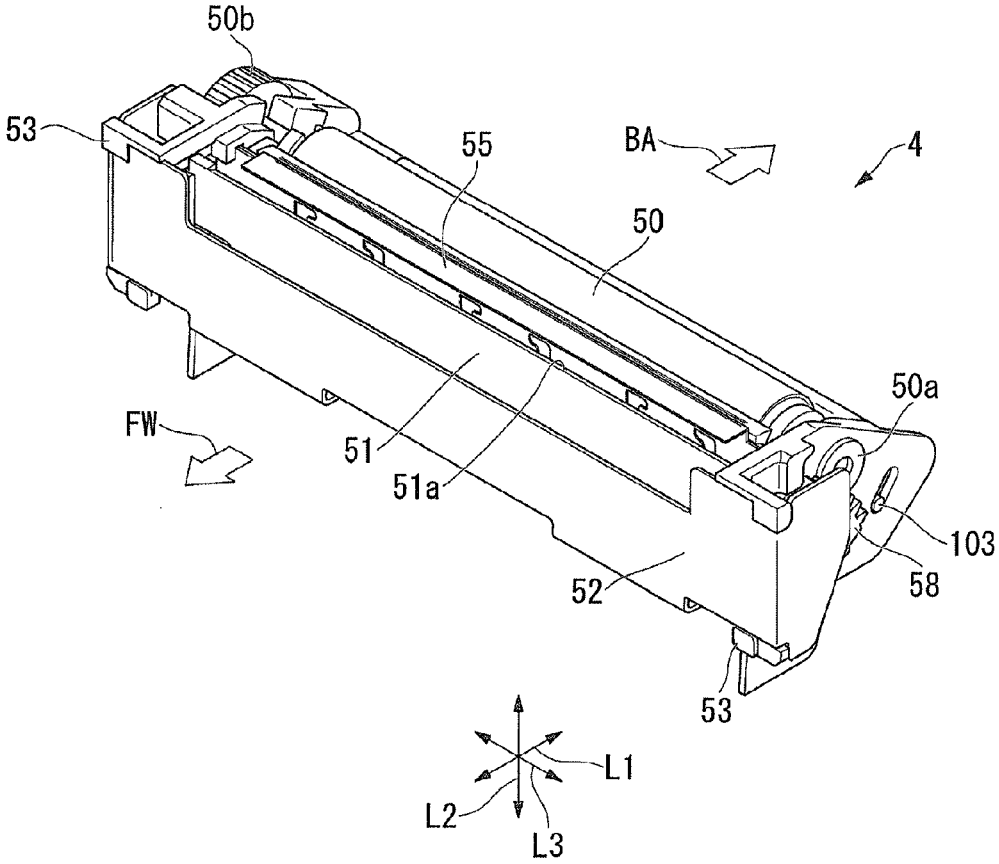
FIG. 5 is a perspective view of a platen unit.
Figure 6:
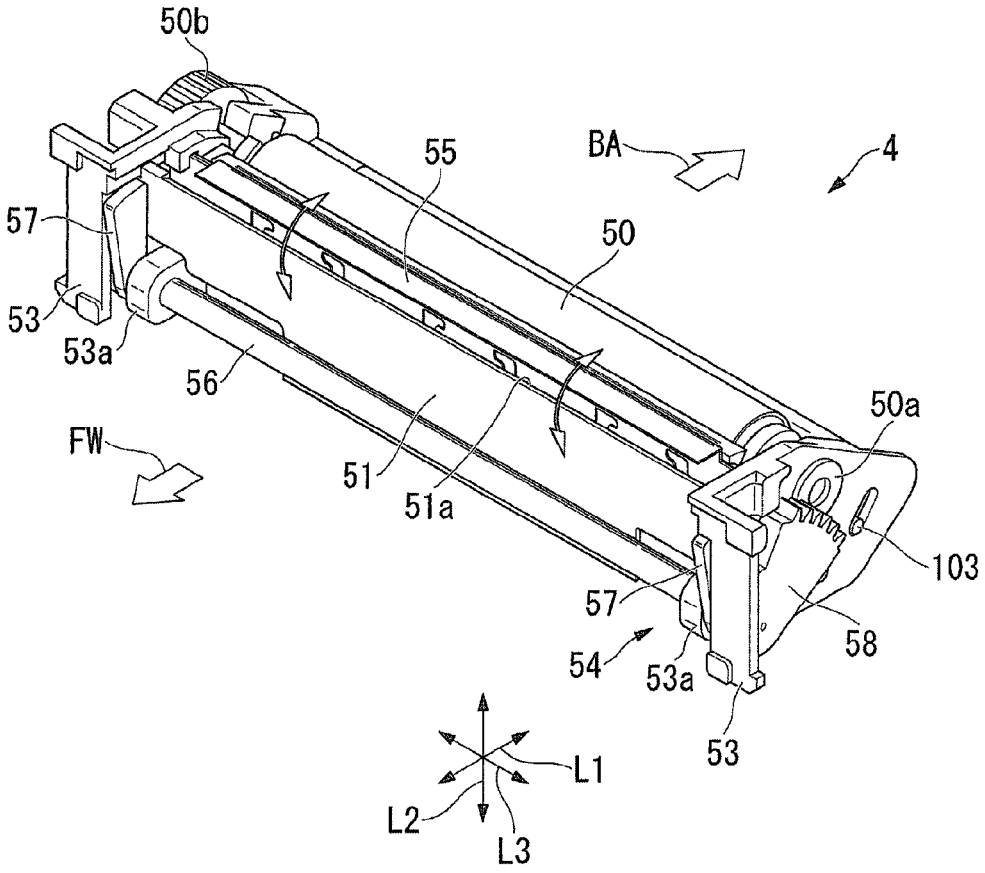
FIG. 6 is a view illustrating a state in which the platen unit is removed from the state shown in FIG. 5.

FIG. 5 is a perspective view of the platen unit 4. FIG. 6 is a view illustrating a state in which the attachment plate 52 (see FIG. 5) is removed from the state illustrated in FIG. 5. Note that the front-rear direction L1, the up-down direction L2, the left-right direction L3, the direction of the arrow FW, and the direction of the arrow BA in FIGS. 5 and 6 are accorded with the respective directions when the printer cover 3 is in the closed state (see FIG. 1). As illustrated in FIGS. 5 and 6, the platen unit 4 includes the platen roller 50 feeding the recording paper P (see FIG. 1), the fixed cutter 51 disposed on the downstream side in the feeding direction of the recording paper P (see FIG. 1) with respect to the platen roller 50, platen frames 53 made of a metal material, for example, and rotatably supporting the platen roller 50, and the attachment plate 52 made of a metal material, for example, and covering the front parts of the platen frames 53.

The platen roller 50 is supported by the platen frames 53 via bearings 50*a* attached to both ends of a not-illustrated shaft body. A driven gear 50*b* is fixed to one end side of the platen roller 50 in a state of being coupled to the shaft body with the bearing 50*a* interposed therebetween. The fixed cutter 51 is a plate-shaped cutter extending in the width direction of the recording paper P (i.e., the left-right direction L3). The fixed cutter 51 is supported by a fixed cutter holder 55 such that a cutter tip 51*a* faces the fed recording paper P when the printer cover 3 is closed.

A lock shaft 103 is attached to the platen unit 4. The lock shaft 103 is positioned behind the platen roller 50, and disposed in parallel with the platen roller 50.

A rotatable shaft 56 is disposed between the fixed cutter 51 and the attachment plate 52 so as to be along the extending direction of the fixed cutter 51 (i.e., the left-right direction L3) on the root side of the fixed cutter 51. The shaft 56 is rotatably supported by bearing members 53*a* fixed to the platen frame 53. Then, a press-down portion 57 and a fan-shaped gear 58 are coupled to one end side of the shaft 56, while only the press-down portion 57 is coupled to the other end side of the shaft 56.

The fan-shaped gear 58 engages with an inner gear 63*a* (see FIG. 8) of a lever unit 63 (described later) provided on the head unit 5 side when the printer cover 3 is closed. Accordingly, the fan-shaped gear 58 and the shaft 56 are configured to rotate in conjunction with the press-down operation of the lever unit 63. The press-down portions 57 are coupled to the shaft 56 so as to be positioned inside the platen frames 53 and at both ends of the fixed cutter 51. Then, the pair of press-down portions 57 rotates together with the shaft 56 in association with the rotation of the fan-shaped gear 58, and shifts the cutter tip 51*a* side of the fixed cutter 51 toward the rear. In other words, the pair of press-down portions 57, the fan-shaped gear 58, and the shaft 56 function as an interlocking mechanism 54 interlocking with the operation of the lever unit 63.

As illustrated in FIG. 4, the head unit 5 is a unit where a thermal head 60 and a movable cutter 61 are assembled. The head unit 5 is provided in the casing 2. More specifically, the head unit 5 is fixed to an inner plate 2*d* that is above the accommodating portion 10 and behind the front wall 2*a* of the casing 2 and that is continuously connected with the upper wall 2*b* of the casing 2.

Figure 7:
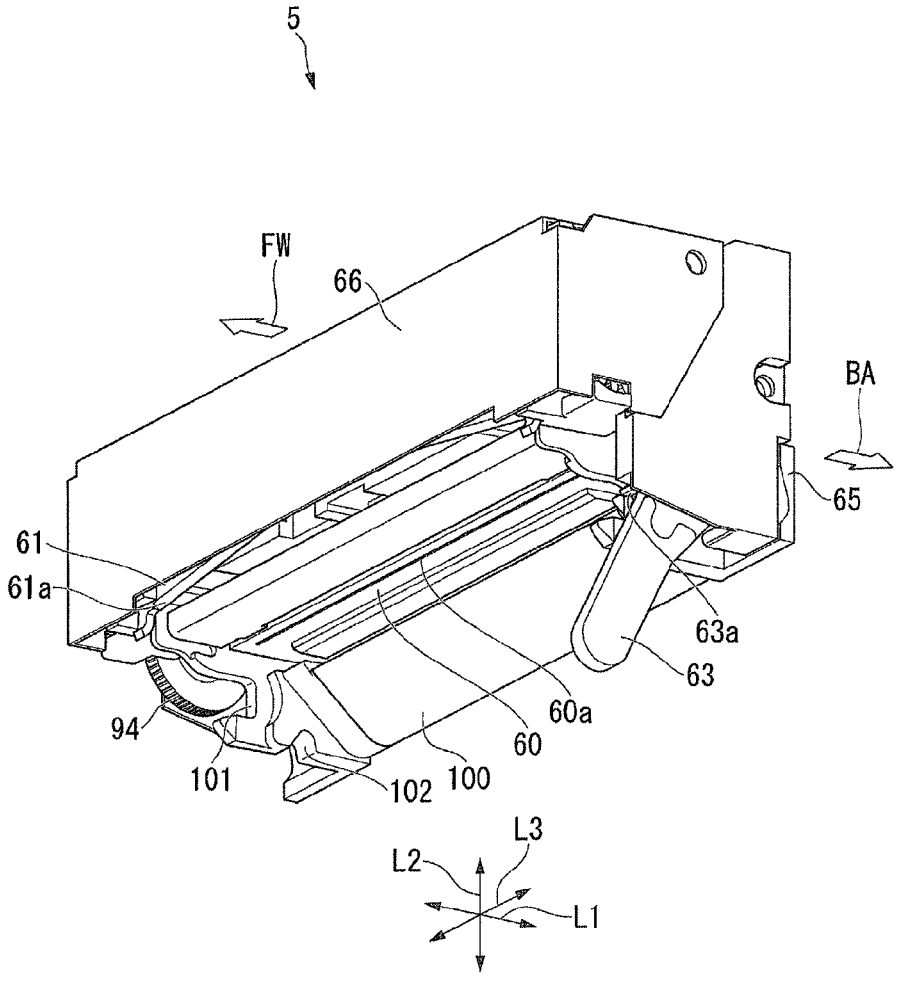
FIG. 7 is a perspective view of a head unit.
Figure 8:
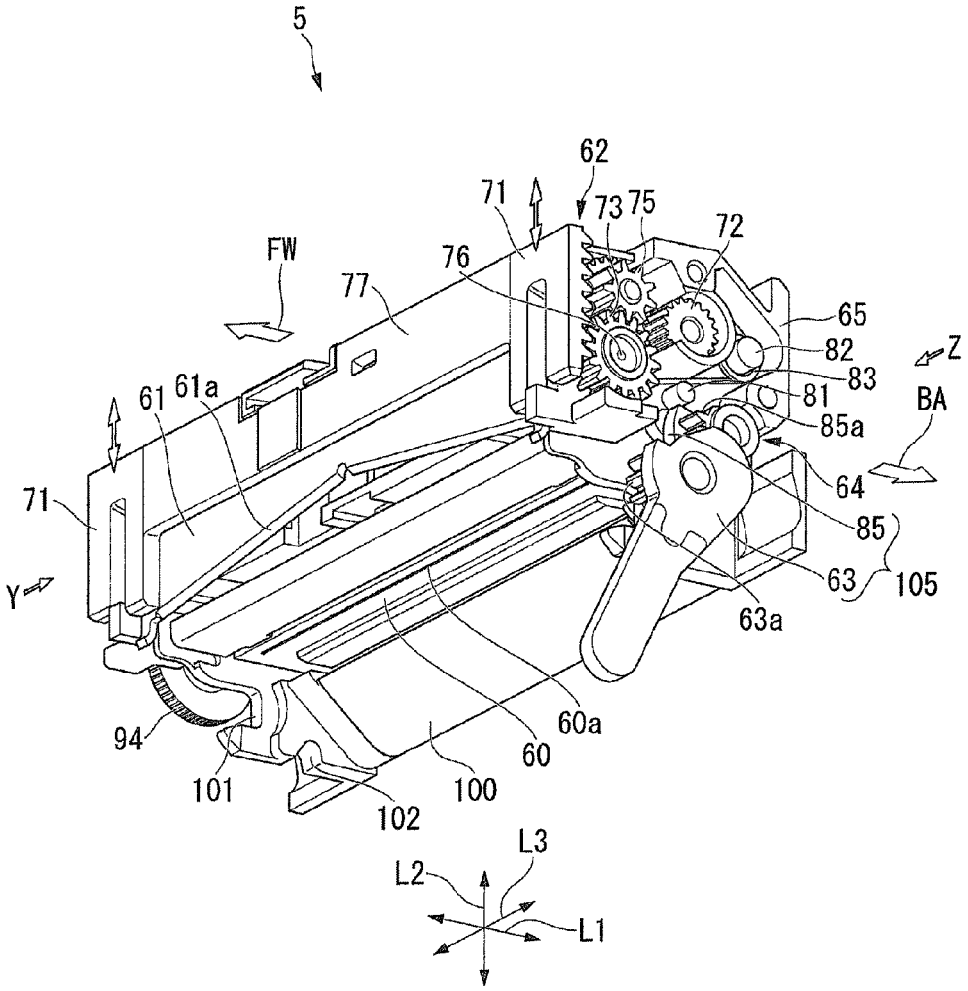
FIG. 8 is a view illustrating a state in which a cover plate is removed from the state illustrated in FIG. 7.

FIG. 7 is a perspective view of the head unit 5. FIG. 8 is a view illustrating a state in which a cover plate 66 (see FIG. 7) is removed from the state illustrated in FIG. 7.

Figure 9:
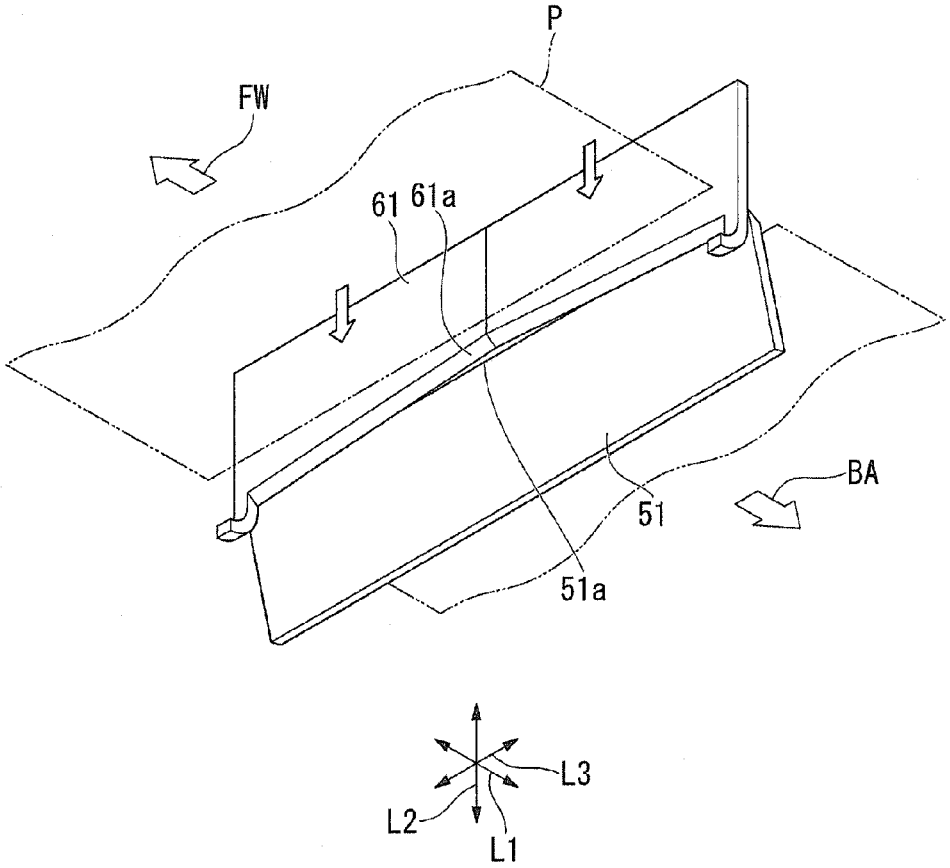
FIG. 9 is a view illustrating a state in which recording paper is cut between a fixed cutter and a movable cutter.

FIG. 9 illustrates a state in which the recording paper P is cut between the fixed cutter 51 and the movable cutter 61. As illustrated in FIGS. 7 and 8, the head unit 5 includes the movable cutter 61 which slides with respect to the fixed cutter 51 (see FIG. 5), a movable cutter driving system 62 driving the movable cutter 61, the lever unit 63 capable of performing rotational operation, a releasing mechanism 64 interlocking with the rotation of the lever unit 63, the thermal head 60 performing recording on the recording paper P drawn out, a support frame 65 made of a metal material, for example, and supporting these components, and the cover plate 66 made of a metal material, for example, and covering the front part of the movable cutter 61.

The movable cutter 61 is disposed at a position facing the fixed cutter 51 when the printer cover 3 (see FIG. 1) is closed and then the head unit 5 and the platen unit 4 (see FIG. 5) are joined with each other. As illustrated in FIG. 8, the movable cutter 61 is a plate-shaped cuter having a substantially V shape as viewed from the front formed such that the length from the root to a cutter tip 61*a* gradually decreases from both ends toward the center.

Figure 10:
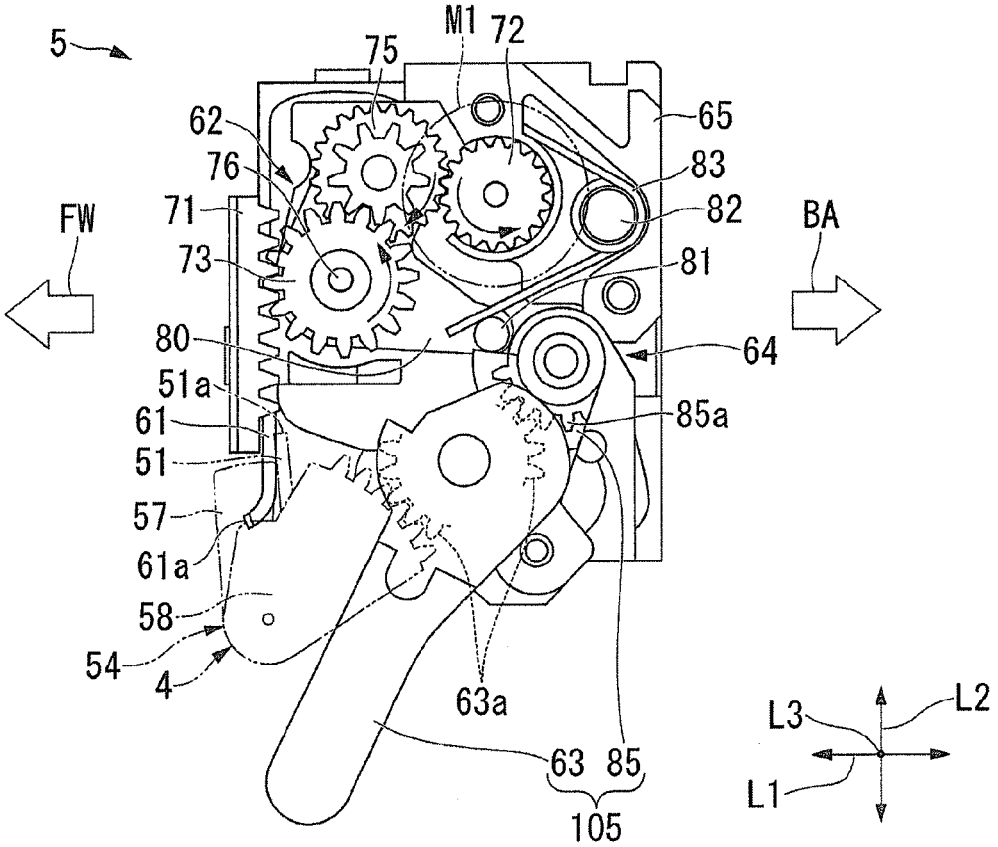
FIG. 10 is a view as viewed in the direction indicated by an arrow Z in FIG. 8.
Figure 11:
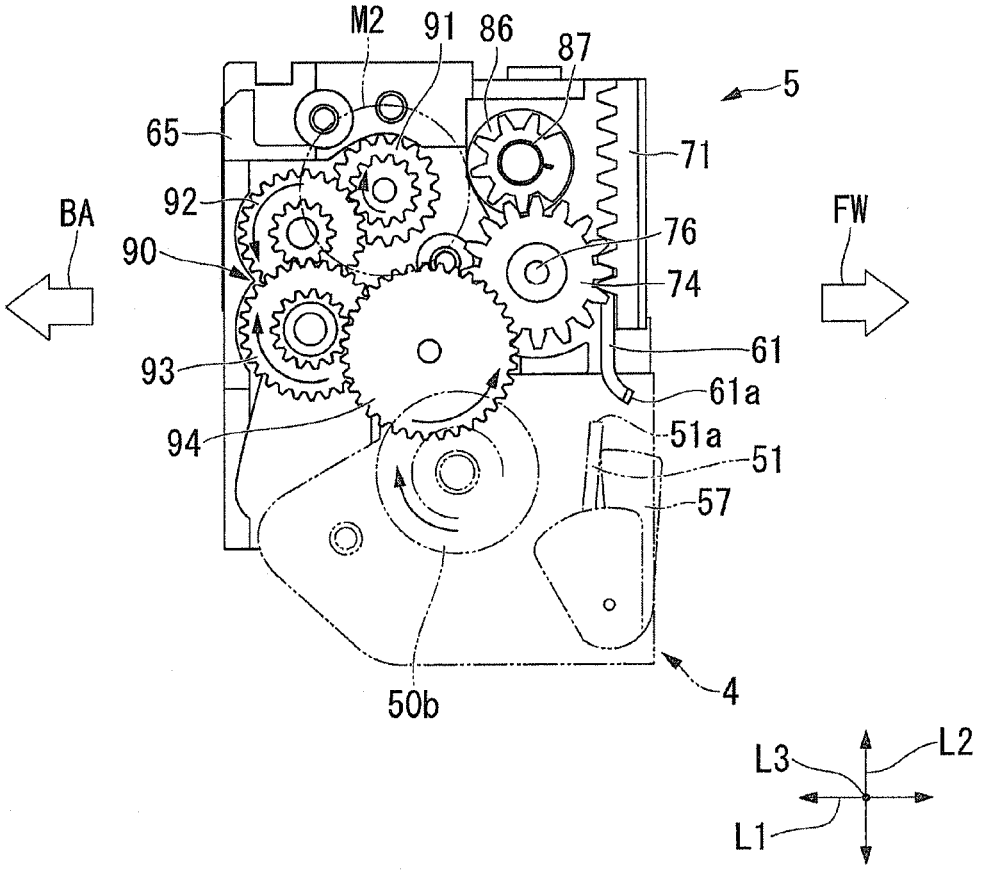
FIG. 11 is a view as viewed in the direction indicated by an arrow Y in FIG. 8.

FIG. 10 is a view as viewed in the direction of an arrow Z in FIG. 8. FIG. 11 is a view as viewed in the direction of an arrow Y in FIG. 8. As illustrated in FIGS. 10 and 11, the movable cutter driving system 62 includes racks 71 attached to the movable cutter 61, and a first gear 73 (see FIG. 10) and a third gear 74 (see FIG. 11) which are in engagement with the racks 71, rotate in association with the rotation of a driving gear 72 coupled to a cutter motor M1 and linearly shift the racks 71 along the up-down direction L2.

The driving gear 72 is coupled to the driving shaft of the cutter motor M1, and disposed on one side surface side of the head unit 5. The first gear 73 is disposed before the driving gear 72 in a state of being in engagement with the rack 71. A second gear 75 engaging with the driving gear 72 and the first gear 73 is disposed between the first gear 73 and the driving gear 72. Accordingly, when the driving gear 72 rotates by the driving of the cutter motor M1, the rotational force is transmitted to the first gear 73 via the second gear 75, and the rack 71 linearly shifts. In other words, the first gear 73 rotates in association with the rotation of the driving gear 72, and linearly shifts the rack 71.

The first gear 73 is coupled to a shaft 76 extending to the other side surface side of the head unit 5. Further, the third gear 74 is in engagement with the rack 71 is coupled to the shaft 76 on the other side surface side of the head unit 5. Accordingly, the third gear 74 similarly rotates in association with the rotation of the first gear 73, and linearly shifts the rack 71 in the same manner.

As illustrated in FIG. 8, the racks 71 are attached to both ends of a support plate 77 fixed to the root side of the movable cutter 61. Accordingly, when the first gear 73 and the third gear 74 (see FIG. 11) rotate, the pair of the racks 71 simultaneously shifts in the same direction, and slides the movable cutter 61 along the up-down direction L2.

As illustrated in FIG. 10, a swing plate 80 having a C shape in the plan view is disposed inside the first gear 73. The swing plate 80 is configured to be capable of swinging to the left and right around the shaft 76 coupled to the first gear 73. The second gear 75 is rotatably supported by the swing plate 80. The second gear 75 swings around the shaft 76 as the swing plate 80 swings.

A pin 81 projecting outwardly toward the head unit 5 is attached to the end of the swing plate 80. The second gear 75 is so designed as to shift in a direction away from the driving gear 72 when the swing plate 80 is moved such that the pin 81 approaches the driving gear 72, and as to shift in a direction of approaching the driving gear 72 when the swing plate 80 is moved such that the pin 81 goes away from the driving gear 72.

A fixing pin 82 is formed behind the driving gear 72. A torsion spring 83 is fixed to the fixing pin 82. One end side of the torsion spring 83 is fixed to the support frame 65, while the other end side of the torsion spring 83 constantly urges the pin 81 in the direction away from the driving gear 72. Accordingly, the second gear 75 and the driving gear 72 are constantly in engagement with each other at a normal time.

The lever unit 63 is disposed adjacent to the swing plate 80. The lever unit 63 is rotatably supported and is rotatable toward the rear. The inner gear 63*a* is formed inside the lever unit 63. A part of the inner gear 63*a* engages with the fan-shaped gear 58 on the platen unit 4 side when the printer cover 3 (see FIG. 2) is closed and then the head unit 5 and the platen unit 4 are joined with each other. Therefore, the interlocking mechanism 54 can be actuated in conjunction with the rotation of the lever unit 63.

A releasing plate 85 having a fan shape is disposed between the lever unit 63 and the swing plate 80. The releasing plate 85 is rotatably supported by the support frame 65. A releasing gear 85*a* is attached to the releasing plate 85. The releasing plate 85 is in engagement with a part of the inner gear 63*a* of the lever unit 63. Accordingly, the releasing plate 85 rotates toward the driving gear 72 side by rotation of the lever unit 63.

The pin 81 of the swing plate 80 urged by the torsion spring 83 abuts on the side surface of the releasing plate 85. Therefore, when rotating toward the driving gear 72 side, the releasing plate 85 can press the pin 81 toward the driving gear 72 side against the urging force of the torsion spring 83, and shift the swing plate 80. As a result, the engagement state between the second gear 75 and the driving gear 72 can be released by separation of the second gear 75 from the driving gear 72, to cause the second gear 75, the first gear 73, and the rack 71 to be in a free state. In other words, by rotation of the lever unit 63, the mechanical linkage between the rack 71 and the driving gear 72 can be separated, and the rack 71 can be caused to be in a free state by the release of the shift regulation of the rack 71. In other words, the swing plate 80, the pin 81, the torsion spring 83, and the releasing plate 85 function as the releasing mechanism 64.

As illustrated in FIG. 11, a pinion 86 engaging with the third gear 74 is rotatably supported by the support frame 65 on the other side surface of the head unit 5. A coil spring 87 is assembled in the pinion 86. When the third gear 74 rotates and slides the movable cutter 61 toward the fixed cutter 51, the coil spring 87 is compressed and urges the pinion 86 to rotate in such a manner that the third gear 74 reversely rotates. At a normal time, however, the third gear 74 relates to the driving gear 72, and therefore does not reversely rotate by the force of the coil spring 87.

However, when the racks 71 become in a free state by the release of the shift regulation of the racks 71 using the releasing mechanism 64 (see FIG. 10), the third gear 74 reversely rotates by the force of the coil spring 87. As a result, the movable cutter 61 can automatically return to the original position. In other words, the coil spring 87 functions as an urging member which automatically returns the movable cutter 61 to the original position when the shift regulation of the racks 71 is released.

Further, there are provided behind the pinion 86, a platen gear train 90 engaging with the driven gear 50*b* on the platen unit 4 side when the head unit 5 and the platen unit 4 are joined with each other, and a platen driving gear 91 coupled to the driving shaft of a platen motor M2 and engaging with the platen gear train 90. The platen gear train 90 includes a fourth gear 92 engaging with the platen driving gear 91, a fifth gear 93 engaging with the fourth gear 92, and a sixth gear 94 engaging with the fifth gear 93 and the driven gear 50*b*. Accordingly, the rotational force of the platen motor M2 can be transmitted to the platen roller 50 when the head unit 5 and the platen unit 4 are joined with each other, and thus the platen roller 50 is allowed to rotate.

As illustrated in FIG. 4, the thermal head 60 is so formed as to extend in the width direction of the recording paper P (i.e., the left-right direction L3), and disposed at a position facing the platen roller 50 (see FIG. 2) when the printer cover 3 is closed. As illustrated in FIG. 7, the thermal head 60 has a plurality of heating elements 60*a* arranged in a line along the left-right direction L3. The thermal head 60 is urged toward the platen roller 50 side by a coil spring 60*b* (see FIG. 4). Accordingly, the thermal head 60 is securely pressed against the recording paper P (see FIG. 1), and thus favorable printing is achievable.

A guide table 100 is formed behind the thermal head 60. The guide table 100 is curved so that the recording paper P (see FIG. 1) can be smoothly drawn in. A fitting hole 101 is formed before the guide table 100. The bearing 50*a* (see FIG. 5) of the platen roller 50 is fitted into the fitting hole 101. In other words, such configuration is adopted that the bearing 50*a* of the platen roller 50 is fitted to the fitting hole 101 when the printer cover 3 is closed, and the platen unit 4 and the head unit 5 are joined with each other.

A lock groove 102 is formed behind the fitting hole 101. The lock groove 102 is a groove with which the lock shaft 103 of the platen unit 4 engages to be locked thereby when the platen unit 4 (see FIG. 5) and the head unit 5 are joined with each other. The platen unit 4 and the head unit 5 are so configured as to be inseparable from each other unless this lock is released.

The lock can be released by utilizing the lever unit 63 and the releasing plate 85. As illustrated in FIG. 10, the releasing plate 85 plays a role of pressing the pin 81 toward the driving gear 72 side and moving the swing plate 80 against the urging force of the torsion spring 83 by the rotation of the lever unit 63 toward the driving gear 72 side. The releasing plate 85 further plays a role of separating the lock shaft 103 (see FIG. 5) from the inside of the lock groove 102 (see FIG. 8) by using a not-illustrated claw in association with further rotation of the lever unit 63. In other words, the lever unit 63 and the releasing plate 85 in the present embodiment function as a unit releasing mechanism 105 which separates the lock shaft 103 from the lock groove 102 to release the join of the head unit 5 and the platen roller 50.

Next, the details of the operation lever 20 provided in the casing 2 are now discussed. As illustrated in FIG. 3, the operation lever 20 is a lever capable of rotating (capable of reciprocating) between a lock position P1 and a release position P2. The operation lever 20 releases the lock of the printer cover 3 when shifted to the release position P2. The operation lever 20 includes a lever main body 21, an operation portion 22, and a projection portion 23. Note that in FIG. 3, the operation lever 20 at the release position P2 is indicated by a two-dot chain line.

The lever main body 21 is disposed below a recessed surface 2*e* lowered by one step from the front wall 2*a* of the casing 2. The lever main body 21 is rotatably coupled to a coupling shaft 24 provided on the frame body and extending in the left-right direction L3. Accordingly, the operation lever 20 is caused to be rotatable upward and downward around the coupling shaft 24.

The operation portion 22 is formed so as to project toward the front from the lever main body 21, and projects to a position before the recessed surface 2*e*. A front end surface of the operation portion 22 is formed in a flat end so as to become substantially flush with the front wall 2*a* of the casing 2. The operation portion 22 has an operation projecting piece 22*a* projecting upward. Accordingly, the operation lever 20 is rotatable from the rear toward the front when the operation projecting piece 22*a* is operated by using the tip of the finger in contact therewith, for example.

The lever main body 21 receives an urging force from a not-illustrated urging member such as a spring. This urging force is a force shifting the operation portion 22 upward. At this time, the operation portion 22 is so positioned as to come into contact with an opening edge of the recessed surface 2*e* in the casing 2 along the front-rear direction. Accordingly, the posture of the operation lever 20 at a normal time is maintained in such a state that the operation portion 22 is horizontally disposed, and that the operation projecting piece 22*a* rises upward. Note that this position corresponds to the lock position P1.

Further, when the operation lever 20 is rotated so as to shift the operation portion 22 downward (the direction indicated by an arrow in FIG. 3) from the lock position P1, the lever main body 21 abuts on a front end surface of one of the side walls 30, and further rotation of the lever main body 21 is regulated, thereby positioning the lever main body 21. Accordingly, the posture of the operation lever 20 is maintained in such a state that the operation projecting piece 22*a* of the operation portion 22 is inclined toward the front. This position corresponds to the release position P2. Accordingly, the operation lever 20 is rotatable between the lock position P1 and the release position P2.

The projection portion 23 is a member having a U-shaped cross section and projecting toward the printer cover 3 from the lever main body 21. The projection portion 23 is coupled to the lever unit 63 in the head unit 5. More specifically, the tip of the lever unit 63 is inserted into the projection portion 23 to be in engagement therewith. Accordingly, the lever unit 63 is operated in conjunction with the rotation of the operation lever 20. The lever unit 63 is rotatable by rotation of the operation lever 20 from the lock position P1 to the release position P2. Accordingly, the lock shaft 103 can be separated from the lock groove 102, thereby releasing the join of the head unit 5 and the platen unit 4.

Figure 12:
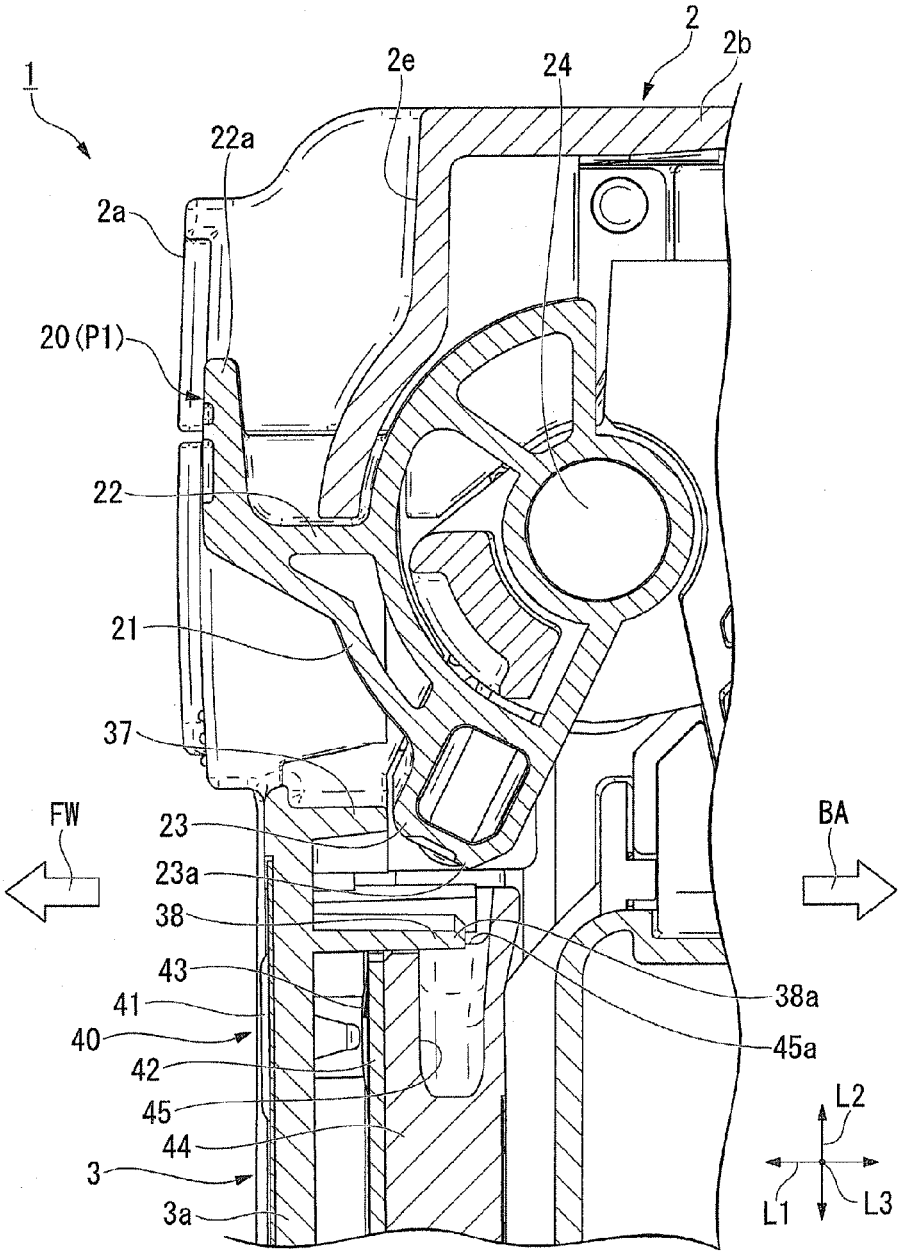
FIG. 12 is an enlarged view of surroundings of the operation lever illustrated in FIG. 3.

FIG. 12 is an enlarged view of surroundings of the operation lever 20 illustrated in FIG. 3. The printer cover 3 is coupled in an openable and closable manner in the angle range of approximately 90 degrees to a rotation shaft 11 (see FIG. 3) as the rotation center. As illustrated in FIG. 12, a closure plate 37 is provided on a main body 3*a* of the printer cover 3. The closure plate 37 closes the clearance between the printer cover 3 and the operation lever 20. The closure plate 37 is formed in an extended shape along the horizontal plane toward the inside of the casing 2 of the thermal printer 1. The tip of the closure plate 37 is slightly separated from the projection portion 23 of the operation lever 20 at the lock position P1. Accordingly, the interior of the thermal printer 1 is difficult to visually recognize from the outside in a usage state of the thermal printer 1.

A control unit 40 is provided on the main body 3*a* of the printer cover 3. The control unit 40 has an operation button 41 and an operation circuit board 42. The operation button 41 is a power source button and a paper feed button, for example. The operation button 41 is disposed in a state of being exposed from the main body 3*a* of the printer cover 3 to the outside surface to allow depression of the buttons. According to the example illustrated in FIG. 1, two operation buttons 41 are disposed below the operation lever 20 and arranged in a line along the up-down direction L2.

As illustrated in FIG. 3, the operation circuit board 42 is a circuit board controlling on/off of the power source and the paper feed operation in accordance with depression of the operation button 41 of the thermal printer 1. The operation circuit board 42 is disposed inside with respect to the main body 3*a* of the printer cover 3, outside with respect to the accommodating portion 10 in the left-right direction L3, and is positioned on the rear side of the operation button 41. There are mounted on the operation circuit board 42, a plurality of not-illustrated electronic components, and a switch 43 (such as a membrane switch) turned on by depression of the operation button 41. Note that a not-illustrated circuit board controlling the overall actuation of the thermal printer 1 is provided within the casing 2.

A protection cover 44 covering the operation circuit board 42 is provided in an exterior of the control unit 40 and on the inner surface side of the main body 3*a* of the printer cover 3. The protection cover 44 is fixed to the main body 3*a* of the printer cover 3 from the inside of the printer cover 3 by using a tapping screw or the like.

Figure 13:
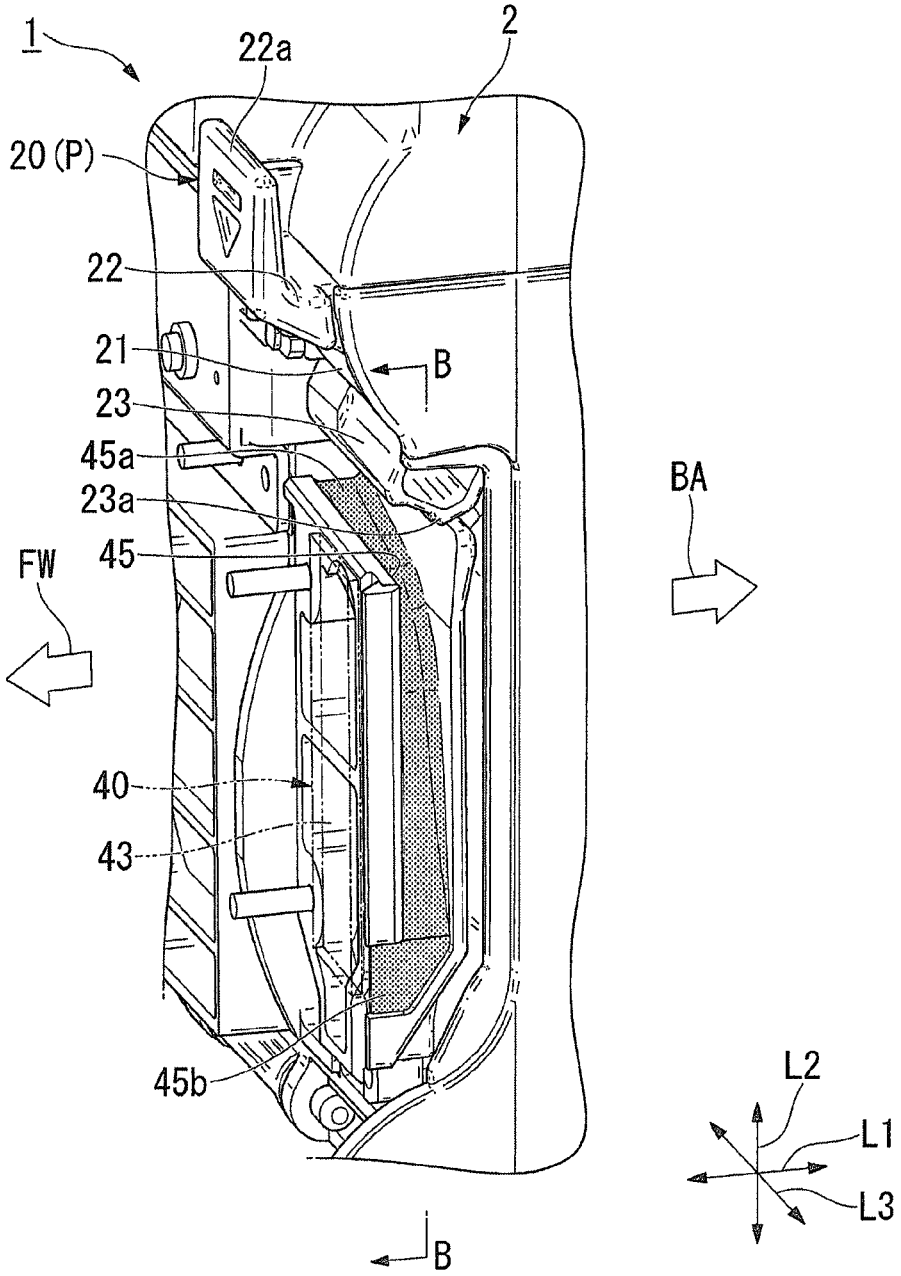
FIG. 13 is a perspective view of surroundings of a protection cover when a main body of a printer cover is removed.
Figure 14:
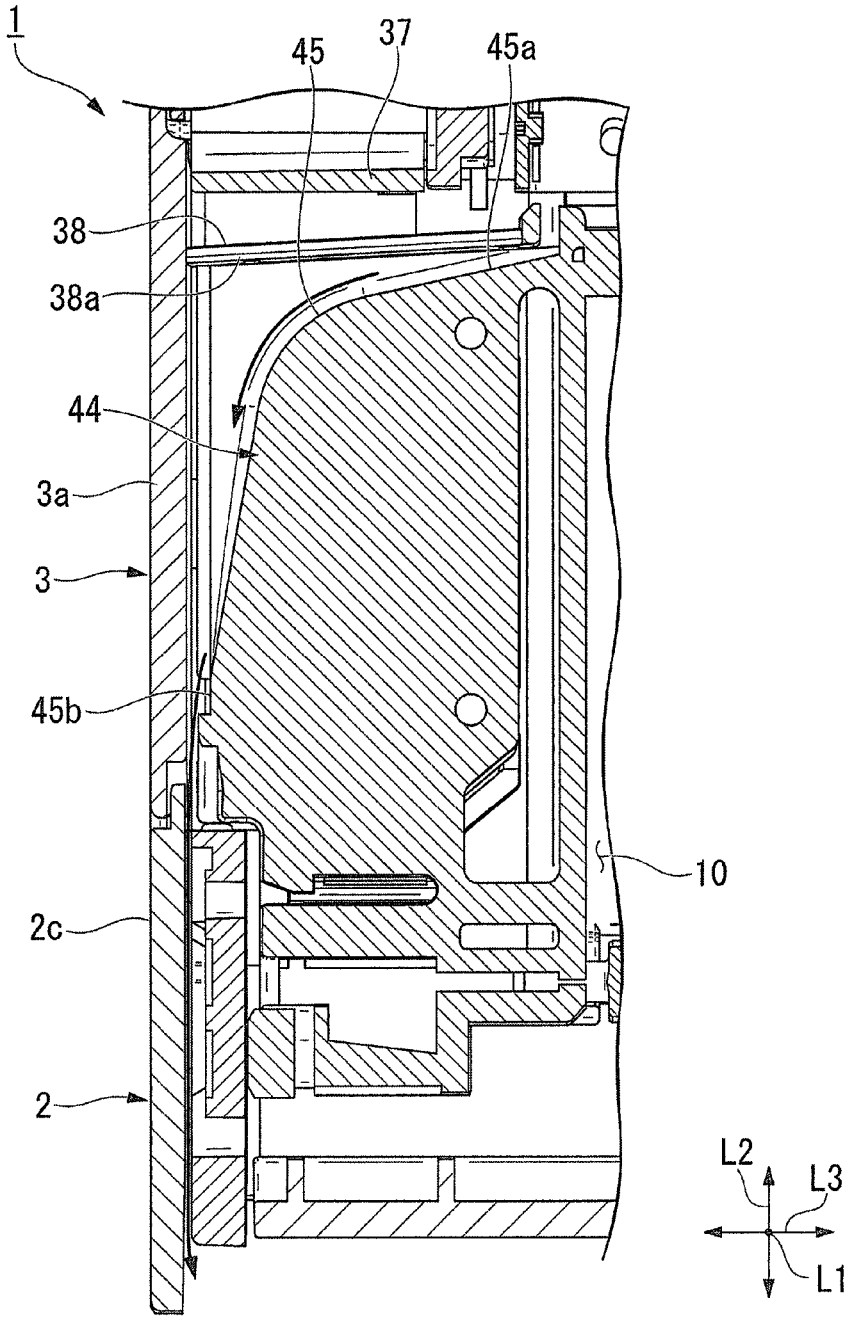
FIG. 14 is a cross-sectional view taken along a line B-B in FIG. 13.

FIG. 13 is a perspective view of surroundings of the protection cover 44 when the main body 3*a* (see FIG. 3) of the printer cover 3 is removed. FIG. 14 is a cross-sectional view taken along a line B-B in FIG. 13. Note that in FIG. 13, the operation circuit board 42 is indicated by two-dot chain lines. As illustrated in FIG. 13, a discharge path 45 is provided in the exterior of the control unit 40. The discharge path 45 has a groove shape formed by a recess in the side surface of the protection cover 44. As illustrated in FIG. 14, the discharge path 45 is formed to be inclined downward from the inside to the outside in the width direction of the thermal printer 1 in the front view.

An upstream side end 45*a* of the discharge path 45 is disposed below the operation lever 20. As illustrated in FIG. 12, a tip 23*a* of the projection portion 23 provided in the operation lever 20 is disposed at a position corresponding to the discharge path 45 above the discharge path 45 when the operation lever 20 is positioned at the lock position P1 (i.e., the printer cover 3 is in the closed state). Accordingly, liquid such as water having traveled along the operation lever 20 is dropped from the tip 23*a* of the projection portion 23 toward the discharge path 45 by gravity. Therefore, liquid having entered from the exterior of the thermal printer 1 is securely introduced into the discharge path 45. The liquid having flowed through the discharge path 45 is dropped downward from a downstream side end 45*b* of the discharge path 45.

An extended portion 38 is formed on the main body 3*a* of the printer cover 3 below the closure plate 37. The extended portion 38 is formed to extend toward the inside of the casing 2 of the thermal printer 1. The extended portion 38 is disposed such that a tip 38*a* is positioned inside the casing 2 with respect to the operation circuit board 42. The extended portion 38 is disposed at a position corresponding to the discharge path 45. Accordingly, since the extended portion 38 is so provided as to cover the operation circuit board 42 as viewed from above, and liquid such as water having traveled along the extended portion 38 is allowed to drop in the discharge path 45, adhesion of liquid to the operation circuit board 42 from above can be securely prevented, and liquid having traveled along the extended portion 38 can be securely introduced into the discharge path 45.

Further, as illustrated in FIG. 14, the extended portion 38 is provided so as to be gradually inclined downward from the inside to the outside in the left-right direction L3 of the casing 2, for example. Accordingly, liquid on the upper surface of the extended portion 38 can be prevented from staying, and liquid can be introduced into the discharge path 45. Note that the direction of inclination of the extended portion 38 is not particularly limited as long as liquid can be introduced into the discharge path 45. Therefore, for example, the extended portion 38 may be formed so as to be gradually inclined downward from the front to the rear. The discharge path 45 communicates with the exterior of the thermal printer 1 in the lower part of the casing 2. Accordingly, the liquid introduced into the discharge path 45 shifts downward through the inside of the discharge path 45 by gravity, is dropped from the downstream side end 45*b*, and is discharged from the lower part of the casing 2 (see arrows in FIG. 14).

According to the present embodiment, by providing the control unit 40 having the operation circuit board 42 on the printer cover 3, there is no need to secure at the casing 2 side a space necessary for attachment of the control unit 40. Accordingly, increase in the size of the casing 2 can be suppressed. Moreover, on the printer cover 3 there is provided the discharge path 45 which leads liquid having entered through between the operation lever 20 and the control unit 40 toward an area below the control unit 40. Thus, liquid can be discharged while preventing adhesion of the liquid to the recording paper roll R accommodated in the accommodating portion 10 of the casing 2, and to the interior of the control unit 40 provided on the printer cover 3. In particular, since the upstream side end 45*a* of the discharge path 45 is disposed below the operation lever 20, liquid having traveled along the operation lever 20 can drop by gravity, and be introduced into the upstream side end 45*a* of the discharge path 45 to flow through the discharge path 45. Accordingly, the thermal printer 1 capable of suppressing increase in size and also capable of securing a drip-proof property can be obtained.

Further, when the printer cover 3 is in the closed state, the tip 23*a* of the projection portion 23 formed in the operation lever 20 is disposed at a position corresponding to the discharge path 45. Thus, liquid having traveled along the operation lever 20 is dropped from the tip 23*a* of the projection portion 23 toward the discharge path 45 by gravity. Accordingly, liquid having traveled along the operation lever 20 can be securely introduced into the discharge path 45, and thus the drip-proof property can be improved.

Further, the extended portion 38 covers the operation circuit board 42 as viewed from above, and the tip 38*a* is disposed at a position corresponding to the discharge path 45. Thus, adhesion of liquid to the operation circuit board 42 from above can be securely prevented and liquid having traveled along the extended portion 38 can be securely introduced into the discharge path 45. There fore, the drip-proof property can be further improved.

Further, the discharge path 45 is formed integrally with the protection cover 44 provided in the exterior of the control unit 40 and covering the operation circuit board 42. Thus, the discharge path 45 can be provided without increasing the number of components and with high spatial efficiency. Moreover, by providing the discharge path 45 on the protection cover 44 that is provided in the exterior of the control unit 40 and that covers the operation circuit board 42, adhesion of liquid to the operation circuit board 42 can be securely prevented. Therefore, the thermal printer 1 with small size and low cost capable of securing an excellent drip-proof property can be provided.

Figure 15:
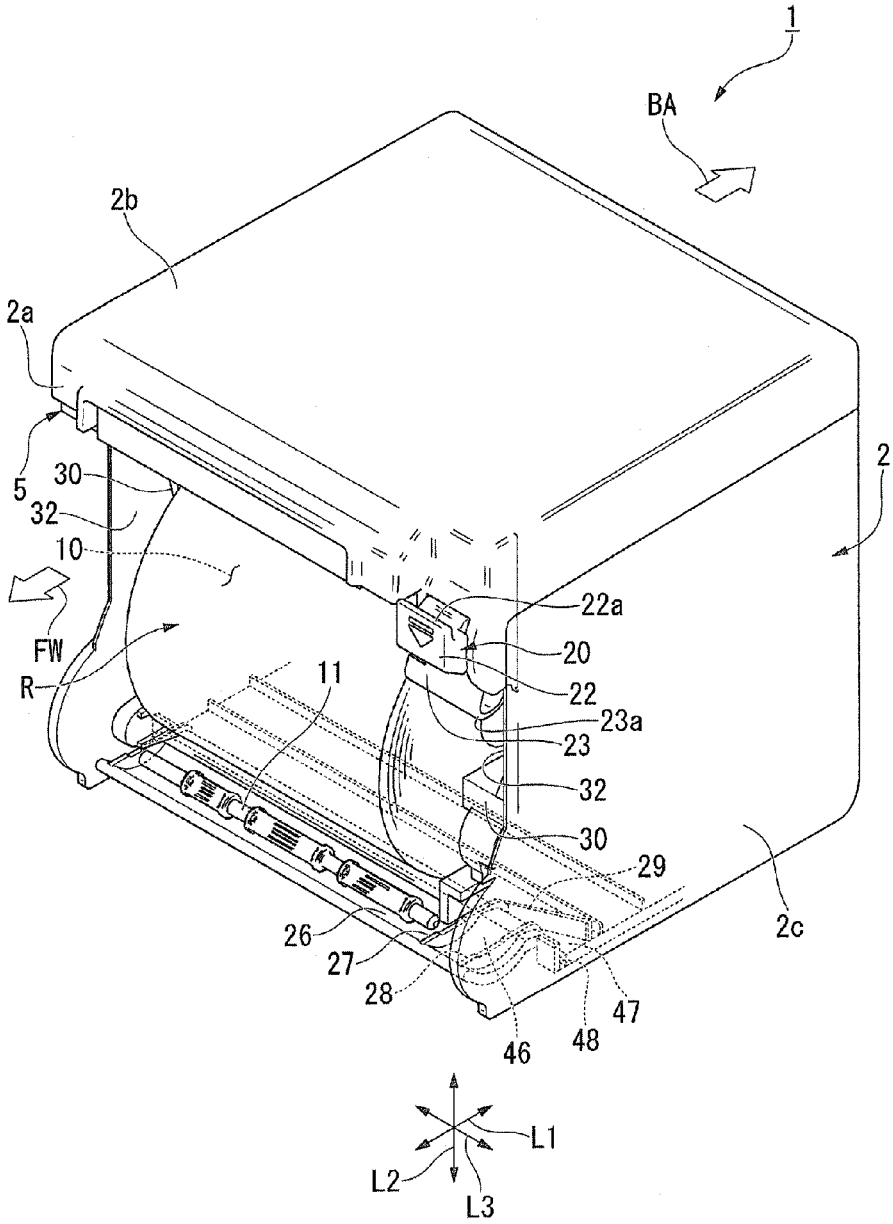
FIG. 15 is a perspective view of a thermal printer according to a modification of the embodiment.
Figure 16:
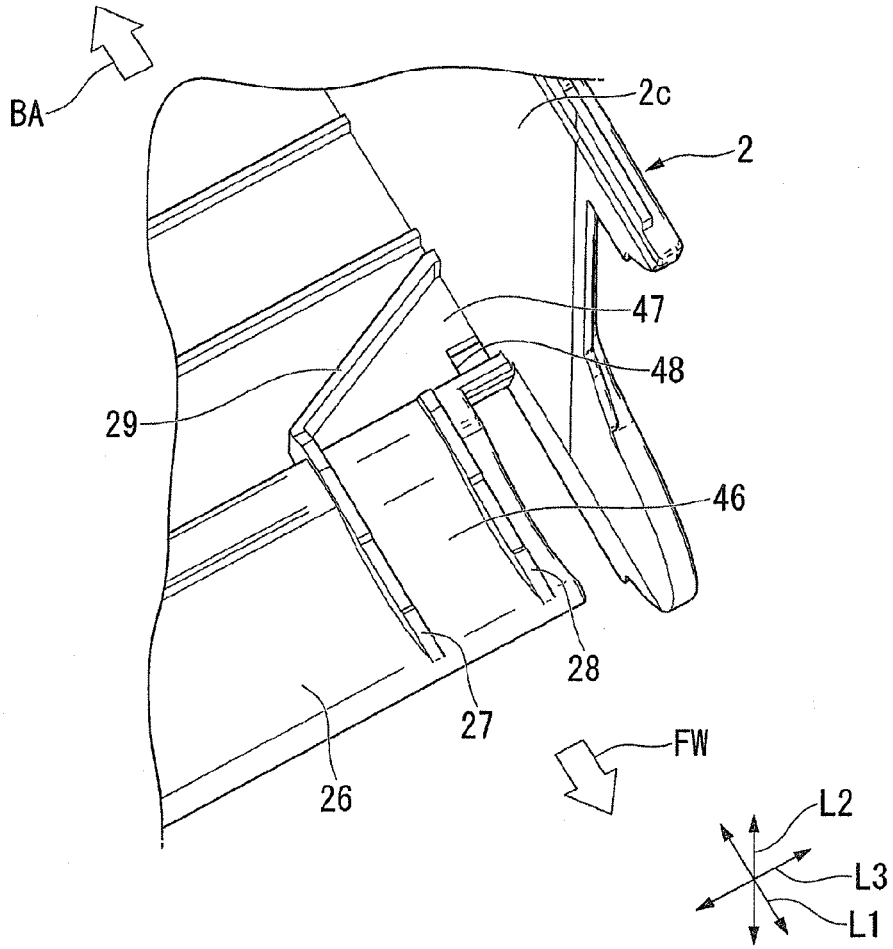
FIG. 16 is an enlarged view of a first reservoir and a second reservoir.

FIG. 15 is a perspective view of the thermal printer 1. FIG. 16 is an enlarged view of a first reservoir 46 and a second reservoir 47. Note that FIG. 15 does not illustrate the printer cover 3. Further, FIG. 16 does not show components other than the casing 2. The thermal printer 1 according to a modification of the present embodiment is now described. According to the embodiment, the discharge path 45 communicates with the exterior of the thermal printer 1 in the lower part of the casing 2, and liquid introduced into the discharge path 45 has been discharged from the lower part of the casing 2 (see FIG. 14). In contrast, as illustrated in FIG. 15, the modification of the embodiment is different from the embodiment in that the first reservoir 46 and the second reservoir 47 are provided in the lower part of the casing 2, and that liquid having entered the interior of the thermal printer 1 flows through the discharge path 45 and stays in the first reservoir 46 and the second reservoir 47, and then is discharged from the lower part of the casing 2. Note that hereinafter, the description of the same constituents as in the embodiment is omitted and only the different portions are described.

As illustrated in FIG. 15, the distal end portion of the lower wall of the casing 2 corresponds to a shaft cover 26. The shaft cover 26 has a concaved curved surface concaved downward as viewed in the left-right direction L3, and covers the rotation shaft 11 from below. The first reservoir 46 is formed on the inner surface of the shaft cover 26 below the downstream side end 45*b* (see FIG. 13) of the discharge path 45. The first reservoir 46 is formed in an area between a first wall 27 and a second wall 28. The first wall 27 is raised upward outside in the width direction of the recording paper roll R accommodated in the accommodating portion 10. The second wall 28 is provided outside the first wall 27 substantially in parallel with the first wall 27. The first reservoir 46 can store a predetermined amount of liquid. Further, the downstream side end 45*b* (see FIG. 14) of the discharge path 45 is disposed on the side opposite to the recording paper roll R with the first wall 27 interposed between the downstream side end 45*b* and the recording paper roll R. Therefore, liquid dropped from the downstream side end 45*b* of the discharge path 45 is prevented from flowing into the recording paper roll R side by the first wall 27.

As illustrated in FIG. 16, the second reservoir 47 is provided behind the first reservoir 46. The second reservoir 47 is formed in an area surrounded by a third wall 29, the side wall 2*c* of the casing 2, and a rear edge of the shaft cover 26. The first reservoir 46 and the second reservoir 47 communicate with each other behind the first reservoir 46. Further, a discharge hole 48 communicating with the exterior is provided in a bottom of the second reservoir 47. Accordingly, when a predetermined amount of liquid or more flows into the first reservoir 46, the liquid flows from the first reservoir 46 into the second reservoir 47, and is discharged through the discharge hole 48 of the second reservoir 47 to the exterior of the thermal printer 1.

According to the modification of the embodiment, the downstream side end 45*b* of the discharge path 45 is disposed on the side opposite to the recording paper roll R with the first wall 27 interposed between the downstream side end 45*b* and the recording paper roll R. Thus, liquid dropped from the downstream side end 45*b* of the discharge path 45 can be prevented from flowing into the recording paper roll R side. Accordingly, adhesion of liquid to the recording paper roll R can be securely prevented.

Moreover, liquid discharged from the discharge path 45 can be stored in the first reservoir 46 provided outside in the width direction of the recording paper roll R. Thus, adhesion of liquid to the recording paper roll R can be securely prevented.

Furthermore, by providing the second reservoir 47 in addition to the first reservoir 46, a larger amount of liquid can be stored. Accordingly, liquid not exceeding the storing limit amount can be stored inside without discharge to the area below the thermal printer 1 and also after an elapse of time, the liquid stored can be evaporated. Thus, the location where the thermal printer 1 is placed does not become wet. In addition, the discharge hole 48 provided in the bottom of the second reservoir 47 allows effective discharge of liquid. Besides, the second reservoir 47 is provided inside the casing 2 with respect to the first reservoir 46, and thus the discharge hole 48 can be provided inside the casing 2 with respect to the first reservoir 46. Accordingly, the discharge hole 48 can be provided while a favorable external appearance of the thermal printer 1 is maintained.

Note that the technical scope of the present invention is not limited to the embodiment described above. Various changes can be made without departing from the spirit of the present invention.

For example, while the thermal printer 1 is discussed in the above embodiment as an example of the printer, the printer is not limited to the thermal printer 1. The present invention is applicable to printers other than the thermal printer 1, including an ink jet printer which performs printing on recording paper by using ink drops.

According to the embodiment, the discharge path 45 is formed integrally with the protection cover 44 of the operation circuit board 42. However, the discharge path 45 may be formed as a separate component from the protection cover 44 of the operation circuit board 42.

Further, according to the modification of the embodiment, the first reservoir 46 is formed by the first wall 27 and the second wall 28. However, the second wall 28 may be eliminated. In this case, the first wall 27 can prevent liquid dropped from the downstream side end of the discharge path from flowing into the recording paper roll R side. Further, according to the modification of the embodiment, the second reservoir 47 is provided in addition to the first reservoir 46. However, only the first reservoir 46 may be provided. Furthermore, a water discharge hole communicating with the exterior of the thermal printer 1 may be provided in the bottom of the first reservoir 46. In addition, constituents in the embodiment described above may be appropriately replaced with known constituents without departing from the spirit of the present invention.

What is claimed is:

1. A printer comprising:

a housing having an accommodating portion that accommodates recording paper and opens in a direction crossing the direction of gravity;

a printer cover coupled to the housing in an openable and closable manner, and closing the accommodating portion;

a control unit provided on the printer cover and having an operation circuit board;

an operation lever provided in the housing at a position above the control unit in the direction of gravity and opening the printer cover; and a discharge path provided on the printer cover outside the control unit and leading liquid having entered through between the operation lever and the control unit toward an area below the control unit in the direction of gravity, wherein the discharge path including an upstream side end disposed on the printer cover below the operation lever in the direction of gravity.

2. A printer according to claim 1, wherein the operation lever includes a projection portion, and the projection portion includes a tip disposed at a position corresponding to the discharge path above the discharge path in the direction of gravity when the printer cover is in a closed state.

3. A printer according to claim 1, wherein the housing includes an extended portion extended toward the inside thereof and provided between the operation lever and the discharge path, the extended portion covers the operation circuit board as viewed from above in the direction of gravity, and the extended portion includes a tip disposed at a position corresponding to the discharge path.

4. A printer according to claim 1, wherein the housing has a partitioning wall raised toward above in the direction of gravity outside in the width direction of the recording paper accommodated in the accommodating portion, and the discharge path includes a downstream side end disposed on a side opposite to the recording paper with the partitioning wall interposed between the downstream side end and the recording paper.

5. A printer according to claim 1, further comprising:

a first reservoir provided outside in the width direction of the recording paper.

6. A printer according to claim 5, further comprising:

a second reservoir provided inside the housing with respect to the first reservoir and communicating with the first reservoir, wherein the second reservoir has a discharge hole provided in the bottom thereof.

7. A printer according to claim 1, wherein the discharge path is formed integrally with a protection cover provided in an exterior of the control unit and covering the operation circuit board.

* * * * *